US005123366A

United States Patent [19]

Graham

[11] Patent Number: 5,123,366

[45] Date of Patent: Jun. 23, 1992

[54] SEWING MACHINE FOOT MOUNTING ADAPTER

[76] Inventor: Donell I. Graham, 2415 Glory C Rd., Medford, Oreg. 97501

[21] Appl. No.: 681,769

[22] Filed: Apr. 8, 1991

[51] Int. Cl.[5] ..... D05B 29/12

[52] U.S. Cl. ..... 112/240

[58] Field of Search ..... 112/240, 235, 60, 61

[56] References Cited

U.S. PATENT DOCUMENTS

| | | | |
|---|---|---|---|
| 1,794,022 | 2/1931 | Levinson | 112/240 |
| 1,930,628 | 10/1933 | Smallbone | 112/240 |
| 3,170,426 | 2/1965 | Micale | 112/240 |
| 3,204,593 | 9/1965 | Steiner | 112/240 |
| 3,511,201 | 5/1970 | Howell . | |
| 3,556,028 | 1/1971 | Yoshikawa | 112/240 |
| 3,973,508 | 8/1976 | Eguchi et al. | 112/240 |

*Primary Examiner*—Werner H. Schroeder

*Assistant Examiner*—Paul C. Lewis

*Attorney, Agent, or Firm*—Fleit, Jacobson, Cohn, Price, Holman & Stern

[57] ABSTRACT

A vertically elongated and oriented adapter including upper and lower ends is provided for removably indexed mounting of the upper end thereof from the lower end of a sewing machine high pressure foot mounting shank and the lower end of the adapter includes structure for predetermined indexed removable mounting of the upper end of a low shank pressure foot therefrom, whereby a sewing machine equipped with a high pressure foot mounting shank may be used conjunction with more readily available and varied types of low shank pressure feet. In addition, the adapter is constructed in a manner such that the associated low shank pressure foot is offset forwardly and laterally with respect to the associated high pressure foot mounting shank.

9 Claims, 1 Drawing Sheet

SEWING MACHINE FOOT MOUNTING ADAPTER

BACKGROUND OF THE INVENTION

1. Field of the Invention

This invention relates to a vertically elongated adapter which may have its upper end mounted from a high pressure foot mounting shank of a sewing machine in pre-determined indexed position relative thereto and the upper end of a low shank pressure foot removably mounted from the lower end thereof, thereby adapting a sewing machine having a high pressure foot mounting shank for use with a low shank pressure foot, the availability of different types of low shank pressure feet being considerably greater than the availability of different types of high shank pressure feet. In addition, a greater number of accessories are available for low shank pressure feet than are available for high shank pressure feet. Further, inasmuch as the relative positions of high pressure foot mounting shanks of "standard" sewing machines and the associated needles is different from the relative positions of a low shank pressure foot mounting shank of a sewing machine and the associated needle, the adapter offsets the associated low shank pressure foot relative to the associated high pressure foot mounting shank in a manner such that the mounted low shank pressure foot enjoys a correct positioning thereof relative to the needle of the sewing machine from whose high pressure foot mounting shank the low shank pressure foot is mounted.

2. Description of Related Art

Various different forms of pressure foot mounting shank-to-pressure foot connections, specific purpose sewing machine pressure feet, pressure foot accessories and adjustable pressure foot mounting structures heretofore have been provided such as those disclosed U.S. Pat. Nos. 1,930,628, 3,170,426, 3,511,201, 3,556,028 and 3,973,508. However, these previously known devices are not constructed in a manner to enable a low shank pressure foot to be mounted from a "standard" sewing machine incorporating a high pressure foot mounting shank.

SUMMARY OF THE INVENTION

The adapter of the instant invention has been specifically designed to provide a means whereby a low shank pressure foot may be mounted from a sewing machine equipped with a high pressure foot mounting shank and with the adapter serving to horizontally offset the supported low shank pressure foot both laterally and forwardly relative to the associated high pressure foot mounting shank such that the low shank pressure foot will be properly positioned relative to the needle of the associated high pressure foot mounting shank equipped sewing machine.

Various different sewing operations are carried out on sewing machines with high pressure foot mounting shanks as well as sewing machines equipped with low pressure foot mounting shanks. However, a greater number of sewing operations are carried out on sewing machines equipped with low pressure foot mounting shanks and, therefore, there is a considerably larger number of different types low shank pressure feet available than high shank pressure feet. Still further, a larger number of different low mounting shank pressure foot attachments are available than high mounting shank pressure foot attachment.

It is therefore the main object of this invention to provide an adapter for a high pressure foot mounting shank sewing machine whereby a low shank pressure foot may be mounted in proper indexed position relative to a needle of a sewing machine equipped with a high pressure foot mounting shank to thereby enable the high pressure foot mounting shank sewing machine to be utilized in carrying out those sewing operations which otherwise may not be carried out on a sewing machine incorporating a high pressure foot mounting shank.

Another object of this invention is to provide an adapter which also may enable a low shank pressure foot to be mounted from a sewing machine equipped with a high pressure foot mounting shank including a cross sectional configuration which is different from the cross sectional configuration of a low pressure foot mounting shank in order that any standard low shank pressure foot may be mounted from the pressure foot mounting shank of a sewing machine equipped with a high pressure foot mounting shank.

Another very important object of this invention is to provide an adapter for mounting between a high pressure foot mounting shank of a sewing machine and a low shank pressure foot and with the adapter and low shank pressure foot being removably supportable from the high pressure foot mounting shank and the adapter, respectively, in pre-determined indexed positions relative thereto.

A final object of this invention to be specifically enumerated herein is to provide a pressure foot mounting adapter in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, with reference being had to the accompanying drawings forming a part hereof, wherein like numerals refer to like parts throughout.

DESCRIPTION OF THE PREFERRED EMBODIMENT

Referring now more specifically to the drawings the numeral 10 generally designates a typical form of sewing machine equipped with a vertically oriented high pressure foot mounting shank 12 and a vertically reciprocal needle shank 14 disposed forward of the shank 12 and from which a needle 16 is supported.

Figure 1:
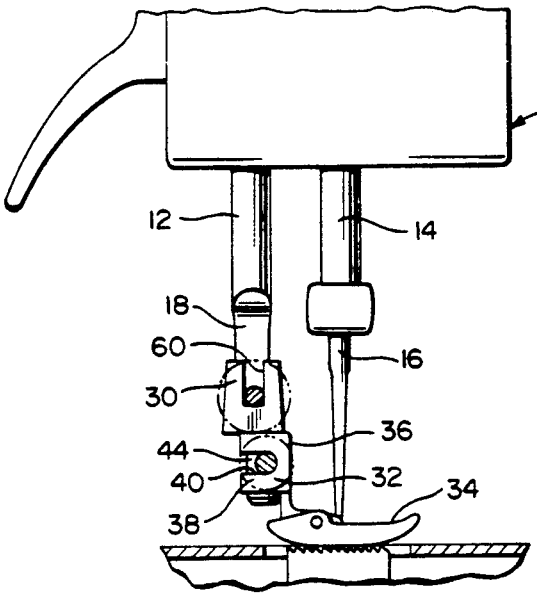
FIG. 1 is a fragmentary left side elevational view of a typical form of sewing machine equipped with a high pressure foot mounting shank and with the adapter of the instant invention supporting a low shank pressure foot from the high pressure foot mounting shank, portions of the clamp screws of the adapter being broken away and illustrated in vertical section.
Figure 2:
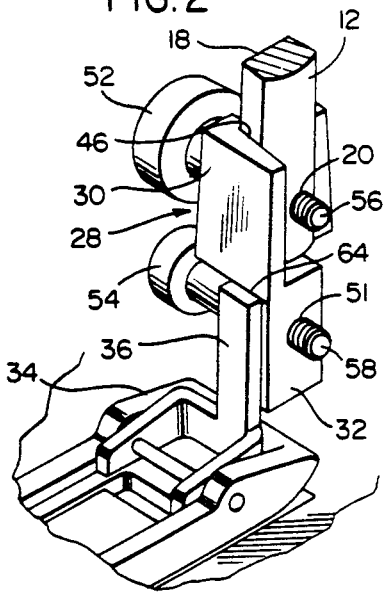
FIG. 2 is a fragmentary front top perspective view of the right side of the adapter on an enlarged scale also fragmentarily illustrating adjacent portions of the low shank pressure foot and high pressure foot mounting shank.
Figure 3:
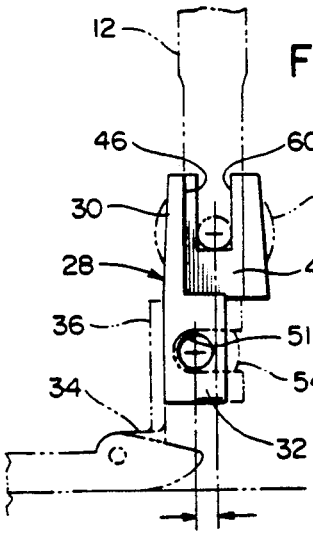
FIG. 3 is a right side elevational view of the adapter with the adjacent portions of the low shank pressure foot and high pressure foot mounting shank fragmentarily illustrated in phantom lines.
Figure 4:
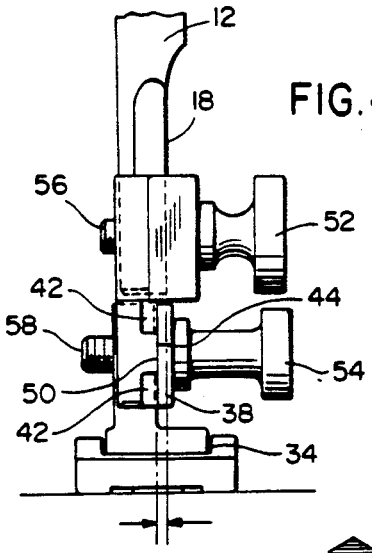
FIG. 4 is an enlarged rear elevational view of the adapter as mounted from the lower end of the high pressure foot mounting shank and illustrating the low shank pressure foot supported from the lower end of the adapter.

The high pressure foot mounting shank 12 defines a first pressure foot mounting surface 18 from which a high shank pressure foot (not shown) is designed to be mounted, the shank 18 having a threaded bore 20 (see FIG. 2) formed therethrough.

Figure 5:
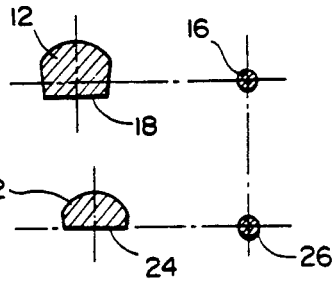
FIG. 5 is a horizontal sectional view illustrating, in the upper portion thereof, the relative positions of a high pressure foot mounting shank and the needle of a sewing machine equipped with a high pressure foot mounting shank and, in the lower portion thereof, a low pressure foot mounting shank and the relative position of the needle of a sewing machine equipped with a low pressure foot mounting shank.
Figure 6:
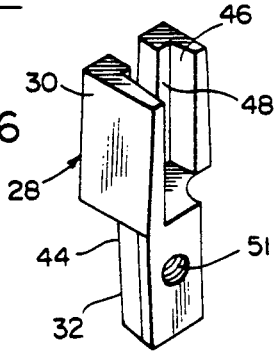
FIG. 6 is a perspective view of the adapter with the associated thumb screws removed.

From the upper portion of FIG. 5 it may be seen that the needle 16 is disposed a pre-determined distance forward of the first pressure foot mounting surface 18 and spaced laterally of the plane of the surface 18 to the side thereof opposite to the direction in which the surface 18 faces. However, with attention now invited more specifically to the lower portion of FIG. 5, a representative low pressure foot mounting shaft is referred to in general by the reference numeral 22 and includes a pressure foot mounting surface 24 corresponding to the surface 18. In addition, a sewing machine equipped with a low pressure foot mounting shank such a shank 22 is equipped with a needle 26 also spaced a predetermined distance forward of the pressure foot mounting surface 24, but with the center axis of the needle 26 lying in the plane of the surface 24 and spaced slightly less forward of the front to rear center of the surface 24 than the needle 16 is spaced forward of the front to rear center of the surface 18.

Thus, if a typical low shank pressure foot is to be mounted from the high pressure foot mounting shank 12 of the sewing machine 10, the typical low shank pressure foot must be offset laterally as well as forwardly relative to the shank 12.

The adapter of the instant invention is referred to in general by the reference numeral 28 and includes upper and lower end portions 30 and 32. A low shank pressure foot is referred to by the reference numeral 34 and includes an upwardly projecting upper portion 36 including a horizontally directed vertical flange 38 horizontally slotted as at 40 and equipped with positioning ears 42 remote from the upper portion 36.

The lower end portion 32 defines a second mounting surface 44 and the upper end portion 30 of the adapter 28 defines a channel 46 whose inner extremity defines a first mount surface 48 while the inner surface of the vertical flange 38 defines a second mount surface 50. Further, substantially the central area of the lower end portion 32 is provided with a threaded bore 51 therethrough corresponding to the threaded bore 20 and first and second thumb screws 52 and 54 have threaded shank portions 56 and 58 threadedly engaged through the bores 20 and 51.

The lower end of the high pressure foot mounting shank 18 is indexed in the channel 46 of the upper end portion 30 of the adapter 20 and secured therein through the utilization of the thumb screw 52 whose shank passes through and is seated in the lower portion of an upwardly opening notch 60 formed in the upper end portion 30. Thus, the thumb screw 52 clamp engages the upper end portion 30 of the adapter 28 to the lower end of the high pressure foot mounting shank 12 in pre-determined indexed position relative thereto. Also, the thumb screw 54 is received through and seated in the inner end of the slot 40 and removably clampingly mounts the vertical flange 38 of the upper portion 36 of the low shank pressure foot 34 to the lower end portion 32 of the adapter 28, the positioning ears 42 being engaged about the side of the lower end portion 32 remote from the upper portion 36. Here again, the upper portion 36 of the low shank pressure foot 34 is mounted from the lower end portion 32 of the adapter 28 in pre-determined indexed position relative thereto.

With attention again invited to FIG. 5, it may be seen that the cross sectional shape and size of the lower end portion of the high pressure foot mounting shank 12 upon which the first mounting surface 18 is defined is different from the typical cross sectional size and shape of a low pressure foot mounting shank defining a first mounting surface 24 corresponding to the mounting surface 18 and that the needle 16 of the high pressure foot mounting shank equipped sewing machine is offset inwardly of the first mounting surface 18 and spaced farther forward from the front to rear center of the first mounting surface 18 than that illustrated in the lower portion of FIG. 5 wherein the needle of a low pressure foot mounting shank equipped sewing machine has its longitudinal center axis disposed in the plane of the mounting surface 24 of the low pressure foot mounting shank. In addition, the needle 26 is not spaced as far forward from the front to rear center of the surface 24 as the needle 26 is spaced forward from the front to rear center of the surface 18. Thus, the channel 46 is of a cross sectional shape to snugly receive the lower end of the high pressure foot mounting shank 12 therein and the second mounting surface 44 defined by the lower end portion 32 of the adapter 28 is of a size to be received within the channel 64 defined by the upper portion 36 of the low shank pressure foot 34 between the opposing surfaces of the upper portion 36 and the positioning ears 42. Accordingly, the channel 64 snugly receives the lower end portion 32 of the adapter 28 therein and the channel 64 as well as the thumb screw 54 serve to securely removably fasten the upper portion 36 of the low shank pressure foot 34 to the lower end portion 32 of the adapter 28 in pre-determined indexed position relative thereto.

Inasmuch as the surface 44 is laterally offset relative to the surface 18 and the channel 64 is forwardly offset relative to the channel 46, when the low shank pressure foot 34 is mounted from the high pressure foot mounting shank 12 through the utilization of the adapter 28, the low shank pressure foot 34 is properly positioned relative to the vertically reciprocal needle 16 of the sewing machine 10 of which the high pressure foot mounting shank 12 comprises a part.

Of course, inasmuch as the upper portion 36 of the low shank pressure foot 34 is identical to the upper portions of many other types of low shank pressure feet, the adapter 28 enables these many other different types of low shank pressure feet also to be mounted from the high pressure foot mounting shank 12. Still further, adapters specifically designed for use in conjunction with various different types of low shank pressure feet such as the low shank pressure foot 34 likewise may be used in conjunction with the sewing machine 10 equipped with the high pressure foot mounting shank 18 through the utilization of the adapter 28.

It is pointed out that the general method of operation of the two main types of sewing machines, i.e., "high shank" and "low shank" is identical. However, there is a difference in shank height of about 0.42 inches and the approximal location of the pressure shank and the needle shaft also is different. Therefore, the main purpose of the adapter 28 is to extend the length of the high shank shaft downwardly and translate the location thereof so that low pressure feet may be properly positioned over the feed dogs and the needle slot in the pressure foot is also in line with the center line of the needle.

The adapter is designed only for the accepted "standard" machines which probably account for more than eighty percent of the machines sold. Inasmuch as high shank feet are not readily available, are more expensive and must be ordered since normally only low shank feet are stocked by stores, the adapter provides a means whereby less expensive and more readily available low shank feet ma be mounted from a high shank sewing machine.

In addition, low shank feet are more readily available including special devices for specialty sewing functions. Therefore, the adapter 28 enables the operator or owner of a high shank sewing machine to enjoy many of the conveniences available to operators of low shank sewing machines.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

WHAT IS CLAIMED AS NEW IS AS FOLLOWS:

1. In combination, a sewing machine incorporating a high pressure foot mounting shank defining a pressure foot first mounting surface, a vertically oriented adapter having upper and lower ends defining an upper end first mount surface and a lower end pressure foot second mounting surface, respectively, a low shank pressure foot including an upper end incorporating a second mount surface, said pressure foot mounting shank and adapter upper end including first coacting means removably mounting said adapter first mount surface from said first mounting surface in a predetermined indexed position thereon, said pressure foot upper end and said adapter lower end including second coacting means removably mounting said second mount surface from said second mounting surface in pre-determined indexed position thereon, said first mount surface and said second mounting surface paralleling each other with said second mounting surface being slightly laterally offset from said first mount surface in the direction in which said first mount surface faces, said second mounting surface also being slightly horizontally offset relative to said first mount surface in a direction paralleling said first mount surface.

2. The combination of claim 1 wherein said first mount surface defines the bottom surface of a first upstanding channel formed in said adapter upper end and opening end wise upwardly therefrom.

3. The combination of claim 2 wherein said first upstanding channel includes opposite side surfaces between which the lower end of said high pressure foot mounting shank is snugly received.

4. The combination of claim 1 wherein said second mount surface defines the bottom surface of second upstanding channel opening end wise upwardly from said low pressure foot upper end and in which the lower end of said adapter is seated with said second mounting surface abutted against said second mount surface.

5. The combination of claim 4 wherein said second channel includes opposite side surfaces between which the lower end of said adapter is snugly received.

6. The combination of claim 5 wherein said first mount surface defines the bottom surface of a first upstanding channel formed in said adapter upper end and opening end wise upwardly therefrom.

7. The combination of claim 6 wherein said first upstanding channel includes opposite side surfaces between which the lower end of said high pressure foot mounting shank is snugly received.

8. The combination of claim 2 wherein said first mount surface includes a central upwardly opening notch formed therein through which to receive the shank of a thumb screw threadedly engaged through the lower end of said high pressure foot mounting shank.

9. The combination of claim 4 wherein said second mount surface includes a horizontally outwardly opening slot formed therein through which the shank of a threaded thumb screw threadedly engaged through the lower end portion of said adapter is received.

* * * * *